US010843308B2

(12) United States Patent
Rodriguez et al.

(10) Patent No.: US 10,843,308 B2
(45) Date of Patent: Nov. 24, 2020

(54) PROTECTOR FOR SHOT-BLASTING

(71) Applicant: SAFRAN AIRCRAFT ENGINES MEXICO, S.A. de C.V., Querétaro (MX)

(72) Inventors: Gumaro Rodriguez, Queretaro (MX); Jesus Camarena, Queretaro (MX); Yohannes Marcelet, Queretaro (MX); Jesus Murillo, Santiago de Queretaro (MX); Allan Puente, Santiago de Queretaro (MX)

(73) Assignee: SAFRAN AIRCRAFT ENGINES MEXICO S.A. DE C.V., Querétaro (MX)

( * ) Notice: Subject to any disclaimer, the term of this patent is extended or adjusted under 35 U.S.C. 154(b) by 229 days.

(21) Appl. No.: 16/067,253

(22) PCT Filed: Dec. 27, 2016

(86) PCT No.: PCT/IB2016/001813
§ 371 (c)(1),
(2) Date: Jun. 29, 2018

(87) PCT Pub. No.: WO2017/115121
PCT Pub. Date: Jul. 6, 2017

(65) Prior Publication Data

US 2019/0009387 A1 Jan. 10, 2019

(30) Foreign Application Priority Data

Dec. 29, 2015 (FR) ..... 15 63424

(51) Int. Cl.
*B24C 9/00* (2006.01)
*B21D 31/06* (2006.01)
*B24B 39/00* (2006.01)

(52) U.S. Cl.
CPC ..... *B24C 9/00* (2013.01); *B21D 31/06* (2013.01); *B24B 39/006* (2013.01)

(58) Field of Classification Search
CPC ..... B24C 9/00; B24C 3/08; Y10T 29/4321; B24B 39/006; B24B 19/14; B21D 31/06;
(Continued)

(56) References Cited

U.S. PATENT DOCUMENTS 6,336,844 B1 * 1/2002 Duquenne ..... B24B 39/006 451/106
2002/0042978 A1 4/2002 Cheppe et al.
2006/0111025 A1 5/2006 Yanaka et al.

FOREIGN PATENT DOCUMENTS

DE 102013107497 A1 * 1/2015 ..... B24B 19/14
FR 2 815 280 A1 4/2002

OTHER PUBLICATIONS

International Search Report as issued in International Patent Application No. PCT/IB2016/001813, dated May 24, 2017.

* cited by examiner

*Primary Examiner* — Pradeep C Battula
(74) *Attorney, Agent, or Firm* — Pillsbury Winthrop Shaw Pittman LLP

(57) ABSTRACT

A guard for a part to be shot-blasted and having an axis of revolution, the guard including: a cover and a chamber shaped for receiving the part to be shot-blasted; the chamber having at least one planar section with a shape matching at least one planar section of the cover; two side guards mounted on the part to be shot-blasted and having one degree of freedom relative to the chamber and the cover, wherein the cover, the chamber and the two side guards form a box for sealing the shot, the box including a window for projecting the shot, the surface of which matches a portion of a surface of the chamber.

9 Claims, 4 Drawing Sheets

(58) Field of Classification Search
CPC .. B29C 35/0261; B29C 65/8292; B29C 71/00
See application file for complete search history.

PROTECTOR FOR SHOT-BLASTING

CROSS-REFERENCE TO RELATED APPLICATIONS

This application is the U.S. National Stage of PCT/IB2016/001813, filed Dec. 27, 2016, which in turn claims priority to French patent application number 1563424 filed Dec. 29, 2015. The content of these applications are incorporated herein by reference in their entireties.

FIELD

The field of the invention is that of protectors of parts to be shot-blasted. More specifically, the field of the invention relates to devices to protect rotating parts which are to be shot-blasted using a projection window allowing shot-blasting in an area. Parts generally shot-blasted of the field of application of the invention relate to mechanical parts containing an axis of revolution which will be rotated during the shot-blasting operation. During this operation one goal is to homogenise the method over an entire region of the part.

STATE OF THE ART

Protective devices currently exist which enable an operation to shot-blast a part to be performed, whilst limiting the impact of the shot on the environment outside the part. Devices protecting parts to be shot-blasted must generally include a fixed portion ensuring a fixed firing area on the rotating part. When the part is rotated during the shot-blasting operation the part's protections can cause friction, and therefore damage to the part to be shot-blasted. The damage of the part can, for example, take the form of scratches.

Another disadvantage is that due to their trajectory, their speed and impacts with the part to be shot-blasted, the shot can reach areas which it is desired to keep clear of shot. Another corollary disadvantage is that shot can be lost or wasted when the shot-blasting operation does not allow any control of re-collection of the shot projected on to the part to be shot-blasted.

Another problem posed is how to design a protective device which is simple to install whilst enabling contact friction with the rotating part to be prevented. Such a protective device requires great precaution when positioning the part to be shot-blasted, so as to reduce the mechanical interactions between the said part and the elements comprising the protective device. Such a positioning is difficult to achieve and reproduce repeatedly.

There is currently no device which can guarantee that no damage will be caused by the mechanical interactions between the part to be shot-blasted and the protective device.

SUMMARY OF THE INVENTION

The invention enables the above-mentioned disadvantages to be resolved.

One object of the invention relates to a protector for a part to be shot-blasted which has an axis of revolution, including:

- a cover and a chamber shaped so as to receive the part to be shot-blasted
- where the said chamber has at least one section the shape of which matches at least a section of the said cover;
- two lateral protectors installed on the part to be shot-blasted, with a degree of freedom relative to the chamber and the cover.

The cover, the chamber and the two lateral protectors form a casing able to contain the shot inside them, where the said casing has a window through which to project the shot, the surface of which matches a portion of a surface of the chamber.

According to one implementation, at least one lateral protector includes a radial extension to limit the friction generated during the rotation of the part to be shot-blasted with the walls of the chamber and/or of the cover.

According to one implementation, the chamber includes a centring system intended to ensure that the chamber is centred relative to the axis of rotation of the part to be shot-blasted, or of at least one protector.

According to one implementation, at least one lateral protector includes a longitudinal extension enabling a support surface to be provided with the centring system when installing the casing around the part to be shot-blasted.

According to one implementation, the centring system includes a portion designed to support a portion of the support surface of a lateral protector during a centring operation, and a means enabling this portion to be made removable, in order to release the contact between the said portion of the centring system and the portion of the support surface of the lateral protector after the centring operation.

According to one implementation, the chamber includes at least one protective element which stops the trajectory of a shot, where the said protective element has a semi-open shape, to form a first space in which the rotating part moves freely, and a second blocking space maintained on the inner walls of the chamber.

According to one implementation, each protective element is U- or V-shaped.

According to one implementation, the chamber includes two first holding devices which cooperate in order to be attached with two second devices intended to hold the cover.

Another object of the invention relates to a method for installing a casing forming a protection of a mechanical part with an axis of revolution which is to be subjected to a shot-blasting operation, including the following steps:

- installation and attachment of two lateral protectors either side of the part to be shot-blasted, having an axis of revolution;
- Insertion of the part to be shot-blasted, fitted with its two lateral protectors which have been securely attached to the said part in a chamber;
- Centring of the part to be shot-blasted fitted with its two lateral protectors relative to the chamber, by means of a centring system;
- Installation of the cover on the chamber from holding devices which cause contact which securely attaches the chamber to the cover.

According to one implementation of the invention the centring step includes the following sub-steps:

- adjustment of a first position of the centring system relative to the axis of revolution of the part to be shot-blasted;
- bringing into contact a portion of a support surface of a lateral protector with a portion of the centring system when the part to be shot-blasted is inserted in the chamber;
- adjustment of a second position of the centring system relative to the axis of revolution of the part to be shot-blasted, such that the centring system is no longer in contact with the lateral protector.

BRIEF DESCRIPTION OF THE FIGURES

Other characteristics and advantages of the invention will be shown clearly on reading the detailed description below, with reference to the appended figures, which illustrate.

DESCRIPTION

According to one implementation part to be shot-blasted 3 is a monobloc disk with vanes. The invention applies to other types of parts to be shot-blasted including, in particular, parts with rotational symmetry or with a geometry forming part of a cylindrical shape.

Figure 1A:
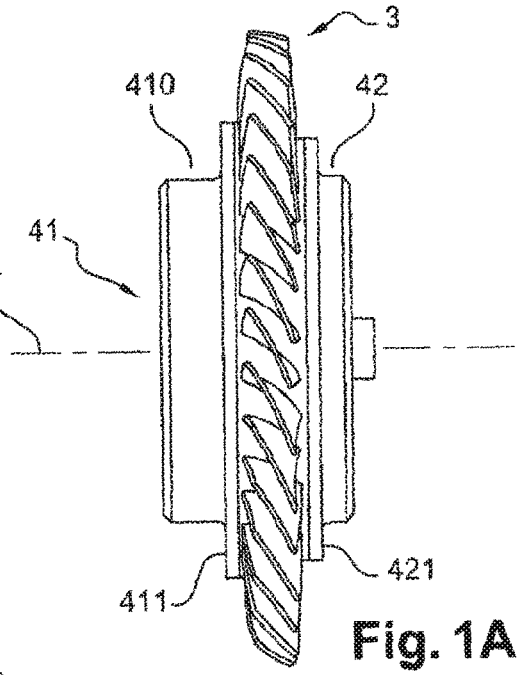
FIGS. 1A, 1B, 1C: perspective views of the various elements of a protective device of the invention.

FIG. 1A represents such a part 3 on which two lateral protectors 41, 42 have been installed either side of its lateral faces. Lateral protectors 41, 42 are designed so as to be held securely attached to part to be shot-blasted 3. To this end it has the same axis of revolution 44 as part to be shot-blasted 3.

Figure 1B:
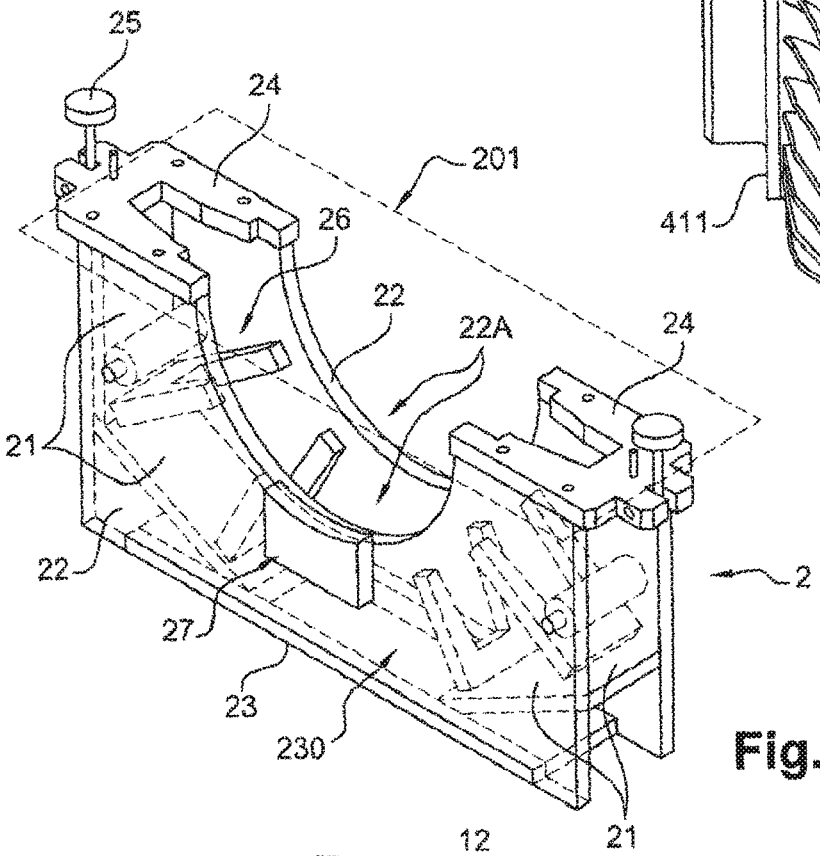
Figure 1C:
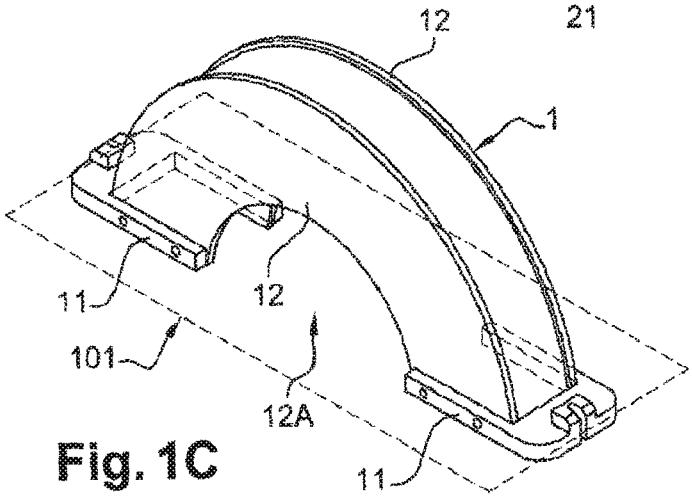

A first lateral protector 41 includes a radial extension 411 enabling contact between part to be shot-blasted 3 and the chamber 2 of FIG. 1B to be prevented. First lateral device 41 also includes a longitudinal extension 410 which extends in the direction of axis of rotation 44. Longitudinal extension 410 enables contact to be made during installation with a centring system 27 of chamber 2 represented in FIG. 1B.

A second device 42 enables the other face of part to be shot-blasted 3 to be protected. This second device 42 can also be fitted with a radial extension 421 intended to protect the other face of part 3 from friction with chamber 2.

FIG. 1B represents a perspective view of chamber 2 of the invention.

According to one implementation, chamber 2 has a general roughly parallelepipedic shape with, on its upper portion in flat section 201, an aperture enabling part to be shot-blasted 3 to be partially inserted into it.

Chamber 2 has two lateral faces 22 parallel to the middle plane of part to be shot-blasted 3, where the said middle plane is perpendicular to axis of revolution 44 of part to be shot-blasted 3. Parallel faces 22 have lateral apertures 22A, or recesses 22A, designed to cooperate with the shape of lateral protective devices 41, 42. These lateral apertures preferentially have a circular profile, a semicircular profile or alternatively a profile corresponding to a portion of an arc of a circle, depending on the position of cross-section 201 of chamber 2.

Chamber 2 also has an aperture 230 of a lower wall 23 which is flat or roughly forming part of a flat surface. The dimensions of aperture 230 are smaller than wall 23, so as to form a window of wall 23. According to one implementation, window 230 is rectangular in shape. According to other implementations, window 230 can have the shape of a parallelogram, a triangle or an oval, such as an ellipse or a circular surface.

Chamber 2 includes walls 21 installed between parallel lateral faces 22.

A first function of walls 21 is to prevent the shot projected within chamber 2 being dispersed.

A second function of walls 21 is to act as a support for U-shaped or V-shaped protective elements 26, which enable the trajectories of the shot inside the chamber 2 to be limited. Chamber 2 includes at least one protective element 26 which stops the trajectory of a shot, where said protective element 26 has a semi-open shape, forming a first space in which a rotating part moves freely, and a second blocking space held on the inner walls of chamber 2.

Some walls 21 are perpendicular to lower wall 23 and other walls 21 are aligned at a predefined angle to lower wall 23. Walls 23 are arranged so as:

- to optimise the confinement of part to be shot-blasted 3 in chamber 2 and;
- to provide a support surface which is preferentially perpendicular to protective elements 26, so as to optimise interception of their trajectory.

Walls 21 and protective elements 26 are installed with an offset greater than the size of the balls, to prevent the creation of areas where balls or shot may accumulate. This ensures that the balls will flow.

In addition, walls 21 also enable a supporting flange to be provided which supports first holding devices 24, which are designed to cooperate with second holding devices 11, designed to hold a cover 1, such as the one represented in FIG. 10.

Chamber 2 includes a centring system 27. According to one implementation, centring system 27 is attached on one of lateral faces 22 of chamber 2 in proximity to circular, or semicircular, lateral aperture 22A. Advantageously, centring system 27 includes an upper portion, including a profile, which is intended to receive a portion of longitudinal extension 410 of a lateral protector 41 when it is installed in chamber 2. According to one implementation, the profile of the upper portion of centring system 27 is a portion of a cylinder.

Centring system 27 includes a positioning element making the said system removable so that it can be moved along an axis. According to one implementation, the positioning element is a wing screw. When the latter is untightened centring system 27 moves towards aperture 23 of the chamber, or away from aperture 22A.

This movement perpendicular to axis of revolution 44 enables part to be shot-blasted 3 to be centred when installing the said part in the chamber 2. Centring system 27 is initially held in a position where it can receive lateral protector 41 and support it. In a second step centring system 27 is lowered, allowing protector 41, driven by the rotation of part to be shot-blasted 3, to rotate freely.

FIG. 10 represents a cover 1 including two parallel faces 12, each forming a portion of a hollow disk, i.e. having an aperture or recess 12A which is roughly complementary to aperture 22A of corresponding lateral face 22. Cover 1 includes a lower section included in a section plane 101. The lower section of cover 1 is designed to cooperate with the upper surface of chamber 2 by means of holding devices 11. When part to be shot-blasted 3 is fitted into chamber 2 and centred relative to chamber 2, cover 1 is attached to the chamber by means of holding devices 11. These latter devices 11 include a flat interface cooperating with holding devices 24 of chamber 2.

According to one implementation, knurled nuts 25, also referred to as "star knobs" 25, are used to attach holding devices 11 and 24 together, so as to attach chamber 2 securely to the cover.

1. The assembly formed by chamber 2, cover 1 and lateral protectors 41, 42 then forms a protective casing, protecting part to be shot-blasted 3.

Figure 2A:
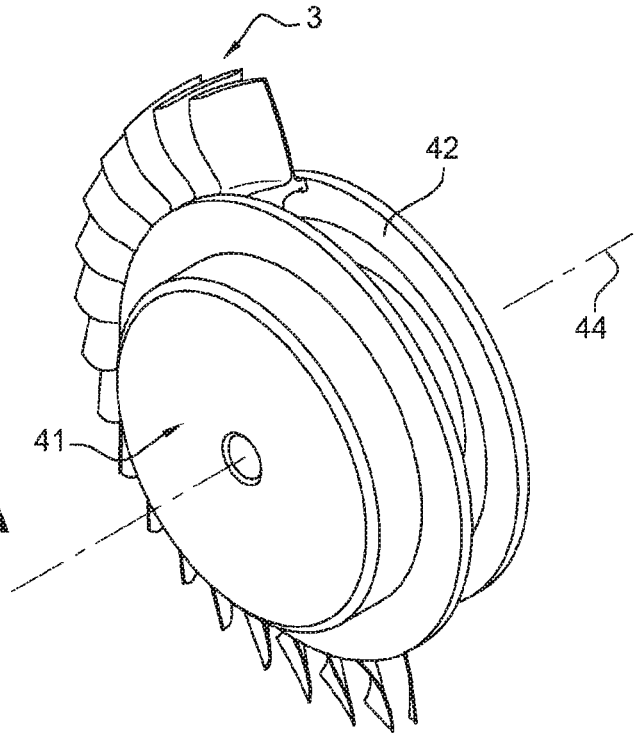
FIGS. 2A, 2B: an example of a chamber forming a protective element according to the protector of the invention.

FIG. 2A illustrates a perspective view of a part to be shot-blasted 3 to which two lateral protectors 41, 42 have been attached. Part to be shot-blasted 3 and lateral protectors 41, 42 can be attached by means of screw-nut systems. According to one implementation, lateral protectors 41, 42 form a solid volume extending in the central portion of part 3 to be shot-blasted. When part 3 to be shot-blasted includes a central structure to attach vanes, the lateral protector can have a profile which is designed to cooperate with this latter structure. Such a structure is not represented in the figures.

Figure 2B:
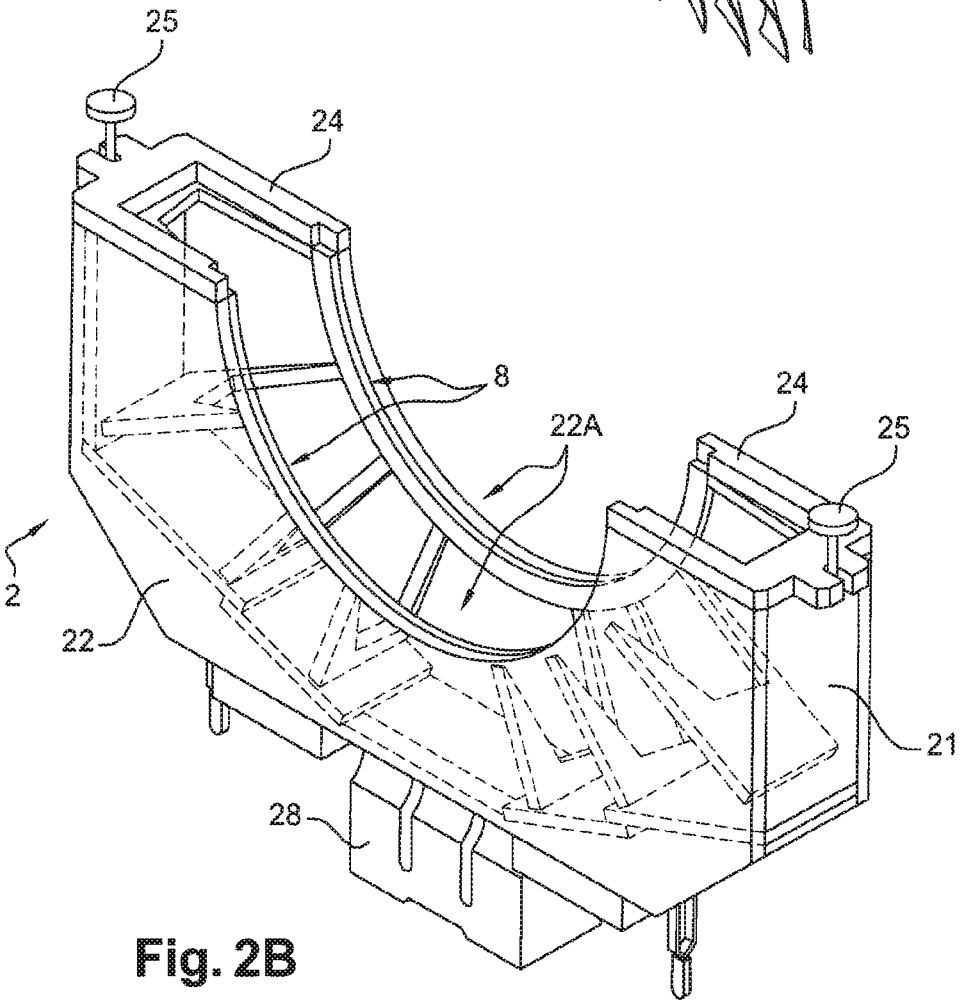

FIG. 2B represents an implementation of the invention in which a conduit 28 is attached to projection window 230. Conduit 28 enables shot to be conveyed from an appropriate device which is not represented in the figures to part 3 whilst limiting the trajectory of the projectiles over areas adjacent to projection window 230. Conduit 28 also enables shot which falls after being projected to be recovered in a channelled manner. This in particular enables wastage to be limited, and maximum quantities of shot to be recovered after the shot-blasting operation.

FIGS. 3A to 3D represent all the elements at different stages of the method of assembly of the invention of the protective casing around part to be shot-blasted 3. An implementation of such a method is described below.

Figure 3A:
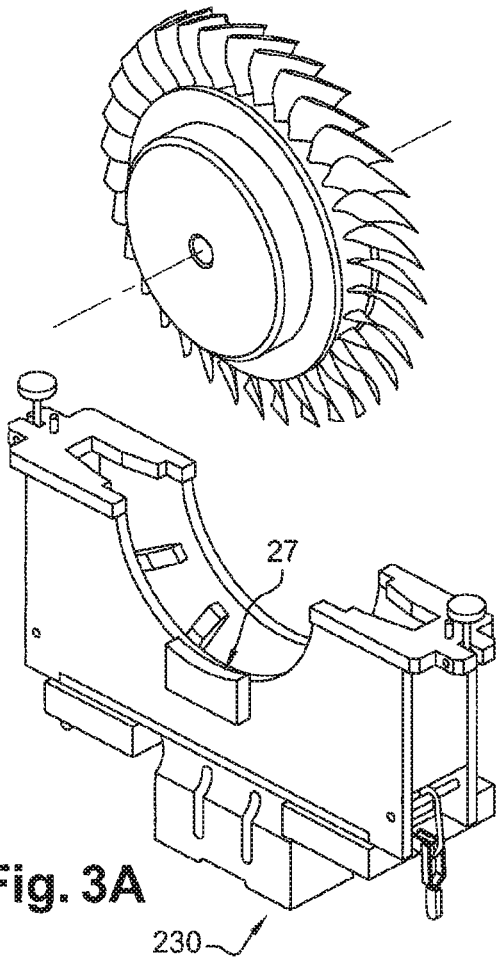
FIGS. 3A, 3B, 3C, 3D: the main steps of the installation of a part to be shot-blasted in a protective casing of the invention.

According to a first step represented in FIGS. 2A and 3A, lateral protectors 41, 42 are positioned either side of part to be shot-blasted 3. Lateral protectors 41, 42 are installed centred around axis of revolution 44 of part 3. Lateral protectors 41, 42 can be installed one after another or simultaneously either side of the part 3. Lateral protectors 41, 42 thus have the same axis of revolution 44 as part to be shot-blasted 3 after they are installed and attached on each side of part to be shot-blasted 3. In this first step lateral protectors 41, 42 are attached to part 3.

Chamber 2 is then positioned roughly in the same plane as part to be shot-blasted 3 to facilitate its insertion. To this end, chamber 2 can be raised by means of a lifting platform.

Figure 3D:
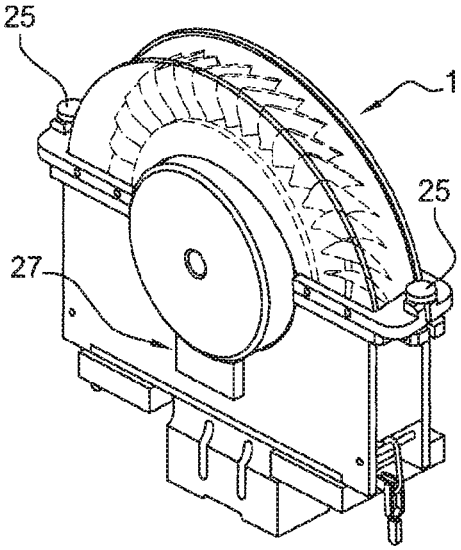
Figure 3B:
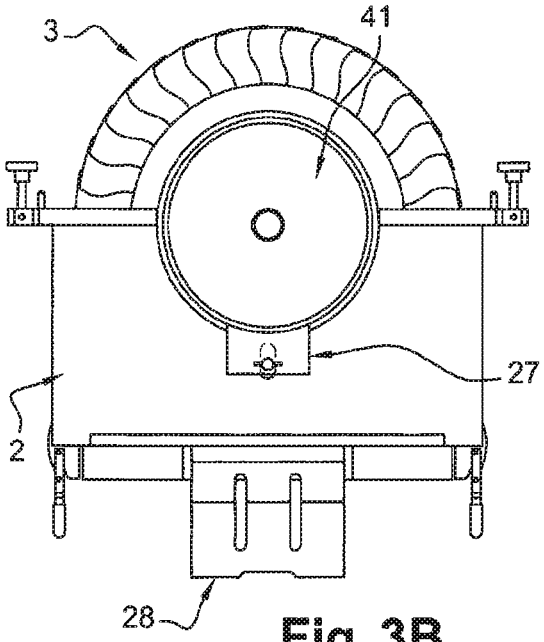

FIG. 3B represents part to be shot-blasted 3 fitted with its lateral protectors 41, 42 and positioned in chamber 2. It is positioned by an operation, such as lifting, of centring system 27 towards adjacent lateral projector 41, until it comes into contact with it.

To this end, lateral protector 41 includes a longitudinal extension 410 to form a support surface with the centring system. When centring system 27 is in contact the position of chamber 2 is fixed, for example, by locking the top of a platform on which it has been installed. The position of part 3 is also fixed after contact is first made.

Figure 3C:
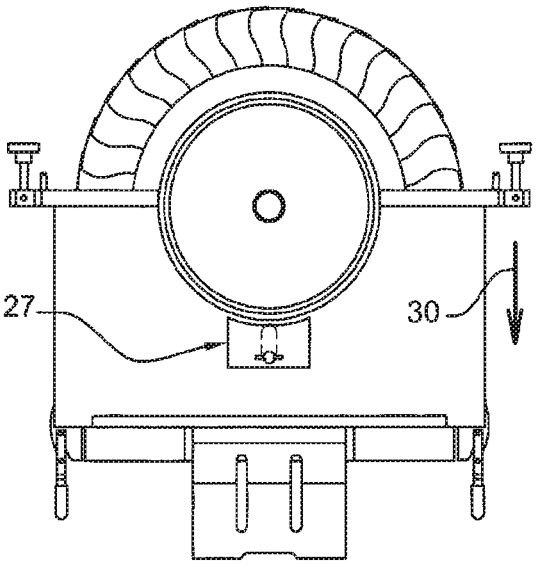

When part 3 and lateral protectors 41, 42 are centred relative to chamber 2 centring system 27 is released, for example by means of a wing screw which enables the portion of centring system 27 in contact with protector 41 to be made movable. FIG. 3C represents this step in which centring system 27 is then no longer in contact with protector 41, after the latter has moved in a linear direction 30, moving it away from the adjacent protector.

The following steps are thus performed:

adjustment of a first position of centring system 27 relative to the axis of revolution of the part to be shot-blasted;

bringing into contact of a portion of a support surface of a lateral protector 41 with a portion of centring system 27 when the part to be shot-blasted is inserted in chamber 2;

adjustment of a second position of centring system 27 relative to the axis of revolution of the part to be shot-blasted, such that centring system 27 is no longer in contact with lateral protector 41.

A final step is represented in FIG. 3D, in which cover 1 is positioned on chamber 2 by means of holding devices 24 designed to hold chamber 2, and of holding devices 11 designed to hold cover 1. Cover 1 and chamber 2 are held together by an attachment device such as knurled nuts 25, represented in FIG. 2B. These maintain a plane contact between holding devices 11 and 24.

The protector and installation method of the invention protect the inner areas of the casing and of part 3, which it is desired should not be affected by the shot-blasting operation, in particular through the presence of lateral protectors 41, 42 and protective elements 26. One advantage is that this limits the spillover of the shot and loss of it. Finally, the protector of the invention and the installation method of the invention allow centring, on the one hand, of lateral protectors 41, 42 and of part to be shot-blasted 3 with, on the other, chamber 2 and cover 1. This centring enables the friction between part to be shot-blasted 3 and the protective elements to be limited. This consequently results in part to be shot-blasted 3 being subject to less damage.

The centring also allows time to be saved in the operation to install the part in its protective casing.

Figure 4A:
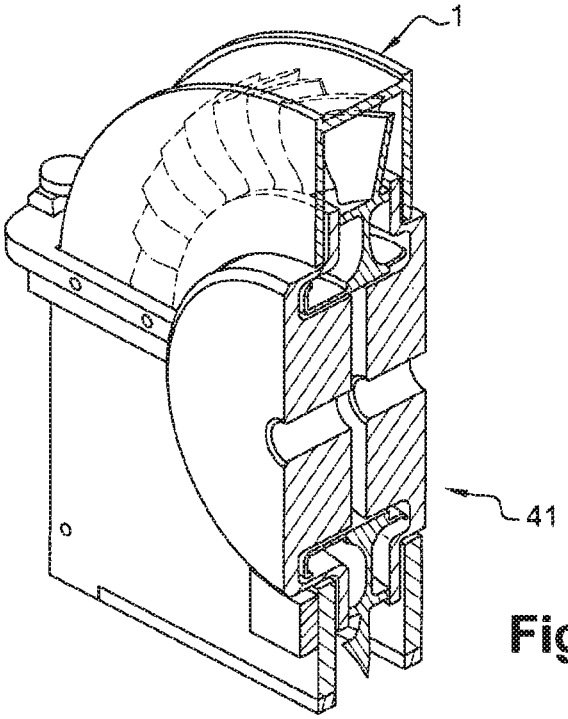
FIGS. 4A, 4B, 4C: various views of the installation, in particular in the area of the join between the moving lateral protectors and the fixed chamber of the casing protecting the part to be shot-blasted.
Figure 4B:
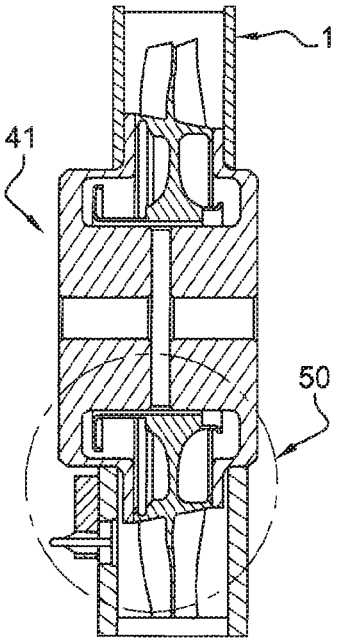
Figure 4C:
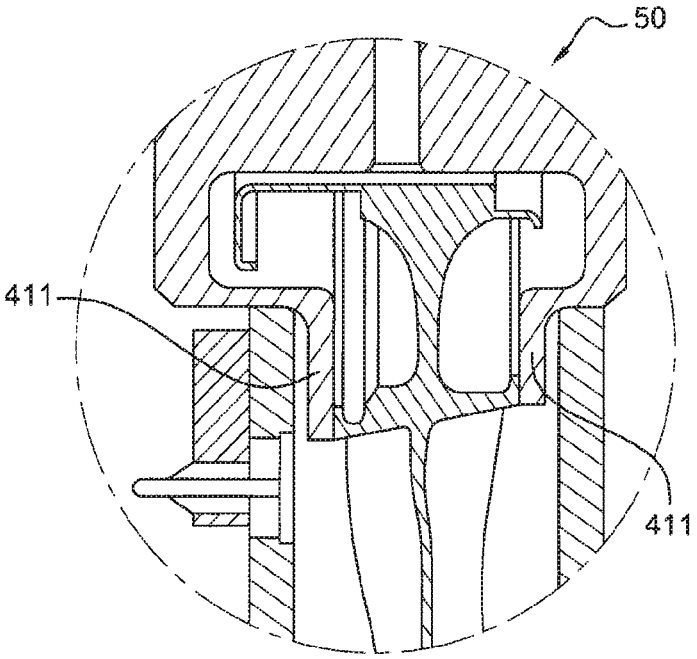

FIGS. 4A, 4B and 4C show a cross-section view of the installation of protectors 41, 42 in the protective casing of the invention surrounding part to be shot-blasted 3.

Area 50 shows radial extensions 411 of lateral protectors 41, 42, which extend between part to be shot-blasted 3 and chamber 2 and cover 1. These extensions 411 enable the shot to be contained during the operation to shot-blast part 3.

These extensions 411 also prevent scratches being made on areas of part 3 which are rotating relative to chamber 2 or to cover 1, which are fixed.

The invention can advantageously be applied in an ultrasonic shot-blasting operation.

The invention claimed is:

1. A method for installing a casing forming a protection of a mechanical part with an axis of revolution which is to be subjected to a shot-blasting operation, comprising:

installing and attaching two lateral protectors either side of the part to be shot-blasted, having an axis of revolution;

inserting the part to be shot-blasted, fitted with its two lateral protectors which have been securely attached to the part in a chamber;

centering the part to be shot-blasted fitted with its two lateral protectors relative to the chamber, by means of a centering system;

installing the cover on the chamber from holding devices which cause contact which securely attaches the chamber to the cover.

2. The method according to claim 1, wherein the centering includes the following two sub-steps:

adjusting a first position of the centering system relative to the axis of revolution of the part to be shot-blasted;

bringing into contact of a portion of a support surface of one of the lateral protectors with a portion of the centering system when the part to be shot-blasted is inserted in the chamber; and adjusting a second position of the centering system relative to the axis of revolution of the part to be shot-blasted, such that the centering system is no longer in contact with the lateral protector.

3. A protector for a part to be shot-blasted, comprising:

a cover and a chamber shaped so as to receive the part to be shot-blasted;

wherein the chamber has at least one section having a shape which matches at least a section of the cover;

two lateral protectors installed on the part to be shot-blasted with a degree of freedom relative to the chamber and the cover, wherein at least one lateral protector includes a radial extension to limit the friction generated during the rotation of the part to be shot-blasted with walls of the chamber and/or of the cover, wherein the cover, the chamber and the two lateral protectors form a casing configured to contain the shot inside them, and wherein the casing has a window through which to project the shot, the surface of which matches a portion of a surface of the chamber.

4. The protector according to claim 3, wherein the chamber includes a centering system configured to ensure that the chamber is centered relative to the axis of rotation of the part to be shot-blasted, or of at least one protector.

5. The protector according to claim 4, wherein at least one lateral protector includes a longitudinal extension enabling a support surface to be provided with the centering system when installing the casing around the part to be shot-blasted.

6. The protector according to claim 4, wherein the centering system includes a portion configured to support a portion of the support surface of a lateral protector during a centering operation, and a means enabling the portion to be made removable, in order to release the contact between the portion of the centering system and the portion of the support surface of the lateral protector after the centering operation.

7. The protector according to claim 3, wherein the chamber includes at least one protective element which stops the trajectory of a shot, wherein the protective element has a semi-open shape, forming a first space in which a rotating part moves freely, and a second blocking space held on the inner walls of the chamber.

8. The protector according to claim 7, wherein each protective element is U- or V-shaped.

9. The protector according to claim 3, wherein the chamber includes two first holding devices cooperating in order to be attached with two second holding devices holding the cover.

* * * * *